US010429081B2

(12) United States Patent
Park et al.

(10) Patent No.: US 10,429,081 B2
(45) Date of Patent: Oct. 1, 2019

(54) COOKING APPARATUS

(71) Applicant: LG ELECTRONICS INC., Seoul (KR)

(72) Inventors: Hyunwoo Park, Seoul (KR); Daebong Yang, Seoul (KR); Ingyu Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 824 days.

(21) Appl. No.: 15/042,984

(22) Filed: Feb. 12, 2016

(65) Prior Publication Data

US 2016/0238259 A1 Aug. 18, 2016

(30) Foreign Application Priority Data

Feb. 13, 2015 (KR) ..... 10-2015-0022169

(51) Int. Cl.
*F24C 15/32* (2006.01)
*F24C 3/08* (2006.01)

(52) U.S. Cl.
CPC ..... *F24C 15/322* (2013.01); *F24C 3/087* (2013.01)

(58) Field of Classification Search
CPC ..... F24C 3/087; F24C 15/322; F24C 15/36; F23D 14/10
See application file for complete search history.

(56) References Cited

U.S. PATENT DOCUMENTS

| | | | |
|---|---|---|---|
| 3,698,377 | A | 10/1972 | Smith |
| 4,909,236 | A | 3/1990 | Del Fabbro |
| 5,497,760 | A | 3/1996 | Alden et al. |
| 2003/0164096 | A1 | 9/2003 | Gruhbaum et al. |
| 2015/0285514 | A1 | 10/2015 | Wie et al. |

FOREIGN PATENT DOCUMENTS

| | | | |
|---|---|---|---|
| DE | 3031041 | | 1/1982 |
| EP | 0 344 743 | | 12/1989 |
| EP | 2 927 600 | | 10/2015 |
| GB | 1354112 | | 6/1974 |
| JP | 2011-169507 | A | 9/2011 |
| KR | 10-1994-0004975 | B1 | 6/1994 |
| KR | 10-0889132 | B1 | 3/2009 |
| KR | 10-2010-0013997 | A | 2/2010 |
| KR | 10-2014-0067731 | A | 6/2014 |

OTHER PUBLICATIONS

European Search Report dated Aug. 17, 2018 issued in EP Application No. 16749454.1.
Korean Office Action issued in Application No. 10-2015-0022169 dated Mar. 14, 2016.
International Search Report issued in Application No. PCT/KR2016/001354 dated May 4, 2016.

*Primary Examiner* — Alfred Basichas
(74) *Attorney, Agent, or Firm* — KED & Associates, LLP

(57) ABSTRACT

A cooking apparatus includes a frame configured to form a cooking chamber; a burner cover provided inside the frame and configured to form a combustion chamber; a burner accommodated in the combustion chamber; a fan provided at an outside of the burner cover in the frame; and a fan cover configured to cover the fan and the burner cover.

16 Claims, 11 Drawing Sheets

COOKING APPARATUS

CROSS-REFERENCE TO RELATED APPLICATION(S)

This application claims priority under 35 U.S.C. § 119 and 35 U.S.C. § 365 to Korean Patent Application No. 10-2015-0022169, filed in Korea on Feb. 13, 2015, whose entire disclosure is hereby incorporated by reference.

BACKGROUND

1. Field

The present disclosure relates to a cooking apparatus.

2. Background

A cooking apparatus may be an apparatus which cooks food using heat from a heating source. As an example of the cooking apparatus, an oven range may include an oven chamber in which the food is cooked, and a burner which may cook the food in the oven chamber by burning a gas. An oven range is disclosed in Korean Patent Publication No. 10-2010-0013997 (published on Feb. 10, 2010) whose entire disclosure is hereby incorporated by reference. In the oven range, a burner chamber may be provided under a bottom surface forming an oven chamber, and a lower burner for convection-heating food in the oven chamber may be installed at the burner chamber.

To transfer air heated by the lower burner from the burner chamber to the oven chamber, the oven chamber and the burner chamber are in communication with each other. However, since the burner chamber is provided under the oven chamber, a part of a bottom surface of the oven chamber should be opened. When a part of the bottom surface of the oven chamber is opened, food leftovers or the like may be introduced into the burner chamber through an opening between the oven chamber and the burner chamber, while the food is put in or taken out of the oven chamber. Therefore, a product may be contaminated by the food leftovers or the like.

Since a part of the bottom surface of the oven chamber is opened, there may also be a problem in that it is not easy to clean the oven chamber due to the opening of the bottom surface. A cavity capacity may be also reduced by a burner installation space since the lower burner is installed under the oven chamber. Due to the lower burner being located under the oven chamber, it may be also difficult to take the lower burner out of a cooking chamber unless the cooking apparatus is disassembled.

BRIEF DESCRIPTION OF THE DRAWINGS

Embodiments will be described in detail with reference to the following drawings in which like reference numerals refer to like elements, and wherein.

DETAILED DESCRIPTION

Figure 1:
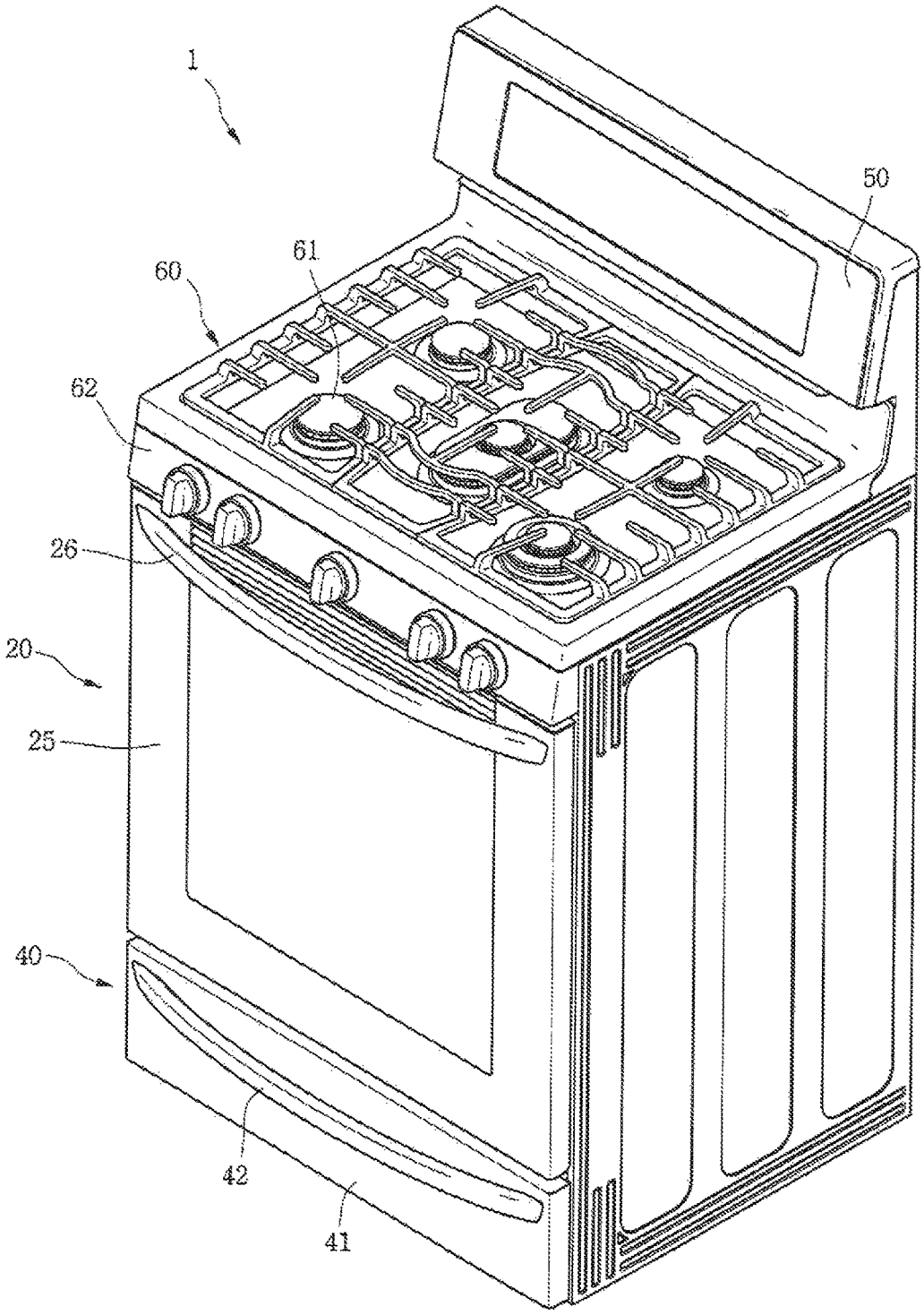
FIG. 1 is a perspective view of a cooking apparatus according to one embodiment.
Figure 2:
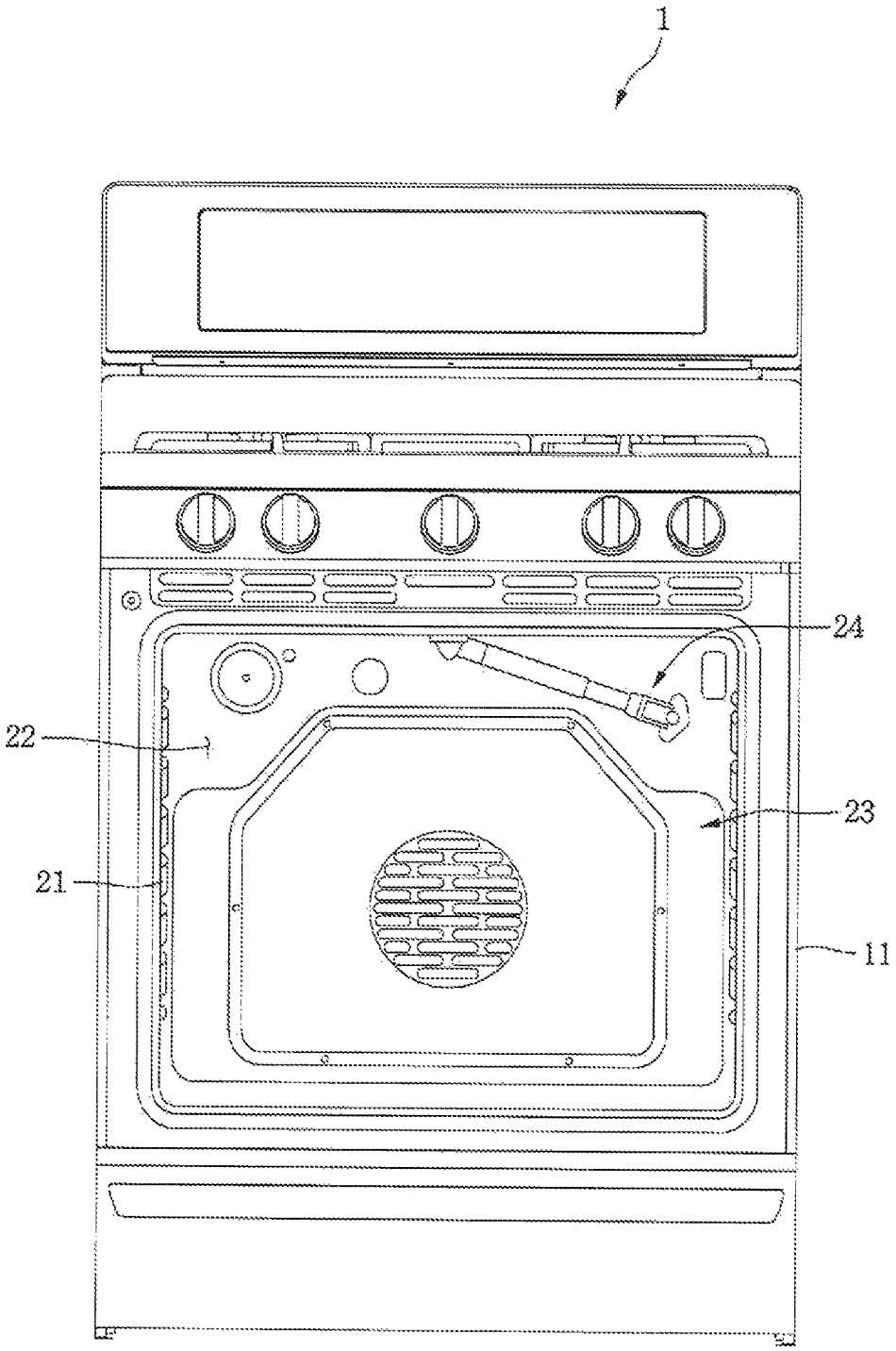
FIG. 2 is a front view illustrating a state in which a door is removed from the cooking apparatus according to one embodiment.

FIG. 1 is a perspective view of a cooking apparatus according to one embodiment, and FIG. 2 is a front view illustrating a state in which a door is removed from the cooking apparatus according to one embodiment. A cooking apparatus 1 may include an oven unit (or an oven) 20. The cooking apparatus 1 may further include a cook-top unit (or a stovetop) 60. The cooking apparatus 1 may further include a drawer unit (or a drawer) 40. The cooking apparatus 1 may further include a control unit (or control panel) 50. An outer case 11 of the cooking apparatus 1 may cover both side surfaces and rear surfaces of the oven unit 20 and the drawer unit 40. The cook-top unit 60 and the drawer unit 40 may be omitted according to a type of the cooking apparatus 1.

The cook-top unit 60, the oven unit 20 and the drawer unit 40 may be provided at an upper portion, a middle portion and a lower portion of the cooking apparatus 1, respectively. The control unit 50 may be provided at a rear end of an upper surface of the cooking apparatus 1.

The cook-top unit 60 may include a plurality of cook-top burners 61. Each of the cook-top burners 61 may cook food by heating a container in which the food is placed or directly heating the food with a flame generated by burning a gas. An operation unit (or operation panel) 62 which operates the plurality of cook-top burners 61 may be provided at a front end of the cook-top unit 60. Alternatively, the operation unit 62 may be provided at an upper surface of the cook-top unit 60.

As another example, the cook-top unit 60 may include one or more electric heaters or induction-heating heaters. However, at least one of the electric heaters or induction heating heaters may not be exposed to an outside of the cook-top unit 60. Therefore, a type of the heating source forming the cook-top unit 60 is not limited.

The oven unit 20 may include a frame 21 which forms a cooking chamber 22 in which cooking of the food is performed. The frame 21 may be formed in a rectangular parallel-piped shape of which a front surface may be opened. The oven unit 20 may include a burner assembly 23 for cooking the food accommodated in the cooking chamber 22. The oven unit 20 may further include an upper burner 24.

The burner assembly 23 and the upper burner 24 may be simultaneously operated, or only one of the burner assembly 23 and the upper burner 24 may be operated. The upper burner 24 may provide heat to the food from above the food in the frame 21, and the burner assembly 23 may be provided at a rear of the food in the frame 21. For example, the upper burner 24 may be installed at an upper wall of the frame 21, and the burner assembly 23 may be installed at a rear wall of the frame 21.

The oven unit 20 may further include a door 25 which opens and closes the cooking chamber 22. The door 25 may be rotatably connected to the cooking apparatus 1. For example, the door 25 may open and close the cooking chamber 22 in a pull-down method in which an upper end of the door 25 is rotated up and down about a lower end thereof. In the embodiment, an operation method of the door 25 is not limited. A door handle 26 which may be gripped by a user's hand may be provided at an upper end of a front surface of the door 25 to rotate the door 25.

The drawer unit 40 may serve as a warming drawer to keep the container into which the food is placed therein at a predetermined temperature. The drawer unit 40 may include a drawer (or drawer body) 41 in which the container is accommodated. The drawer 41 may be inserted into or withdrawn from the cooking apparatus 1 in a sliding motion. A handle 42 may be provided at a front surface of the drawer 41.

The control unit 50 may receive an operation signal for operating the cooking apparatus 1, specifically, an operation signal for operating at least one of the cook-top unit 60, the oven unit 20 and the drawer unit 40. The control unit 50 may display a variety of information of the operation of the cooking apparatus 1 to an outside.

Figure 3:
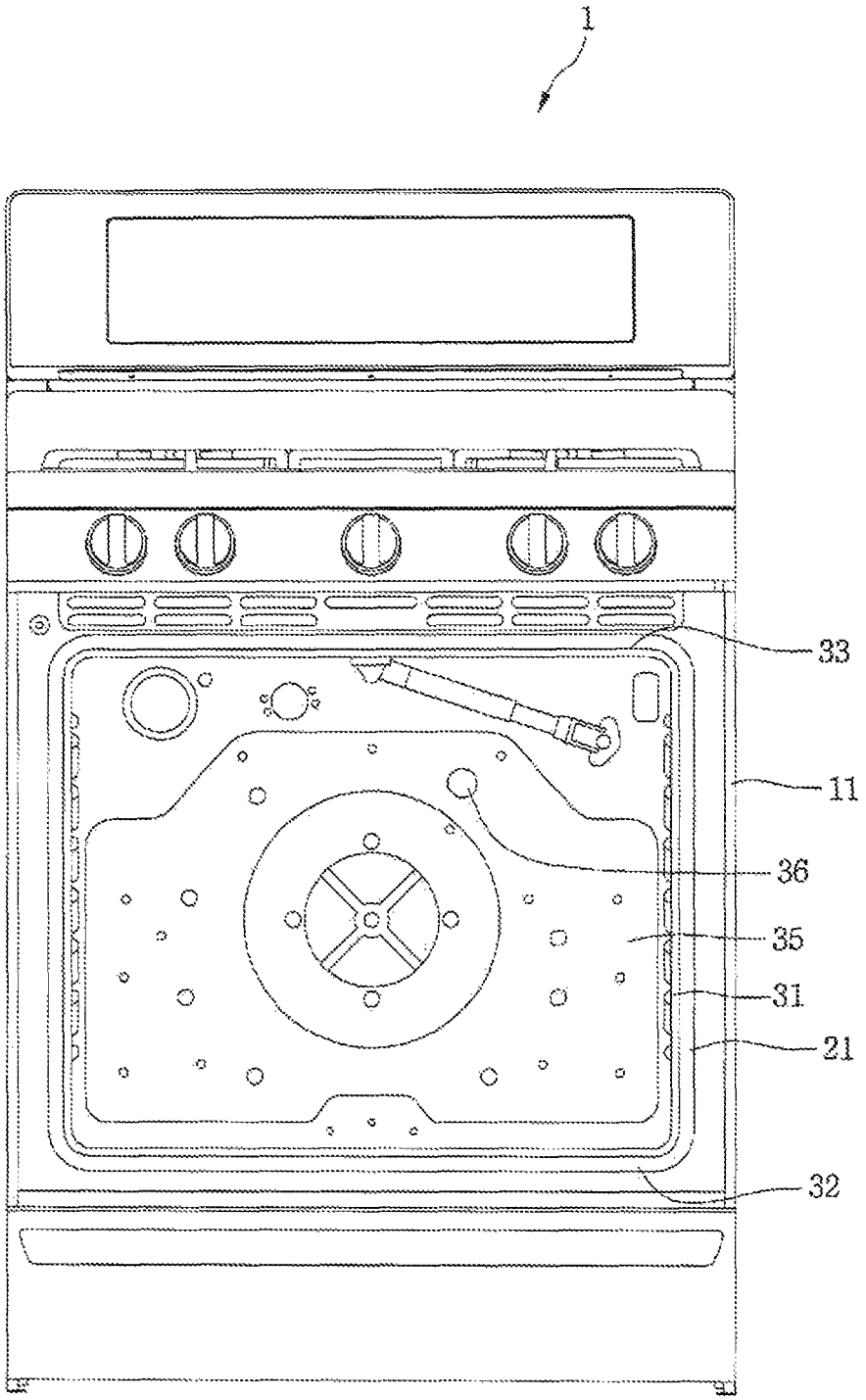
FIG. 3 is a view illustrating a state in which a burner assembly is removed from FIG. 2.
Figure 4:
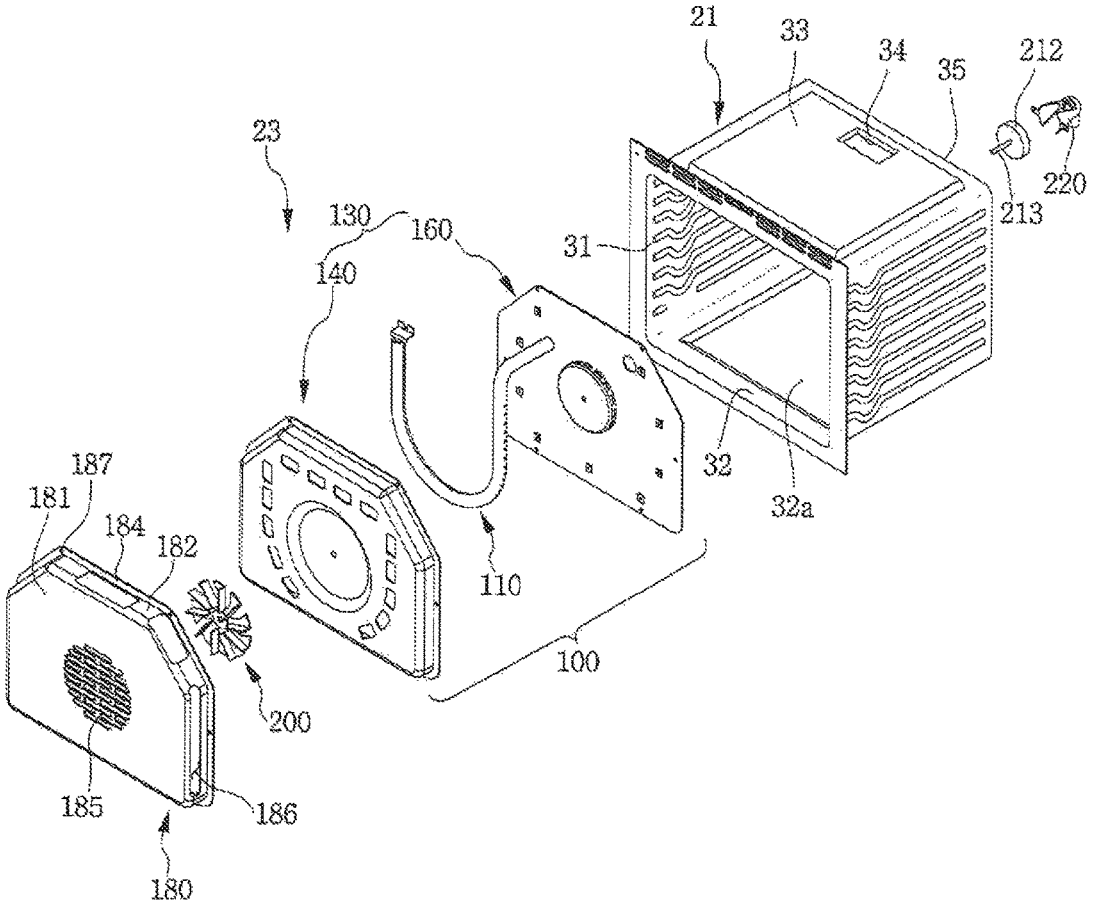
FIG. 4 is an exploded perspective view of the burner assembly according to one embodiment.

Referring to FIGS. 2 to 4, the frame 21 may include both side walls 31, a bottom wall 32, an upper wall 33 and a rear wall 35. The burner assembly 23 may be coupled to the rear wall 35 of the frame 21. Since the burner assembly 23 is not located under the frame 21, but may be installed at the rear wall 35 of the frame 21, a recessed portion 32*a* which is recessed downward may be formed at the bottom wall 32 of the frame 21, and a capacity of the frame 21 may be increased. Alternatively, the burner assembly 23 may be installed at one of the side walls 31 of the frame 21.

The burner assembly 23 may include a burner device 100. The burner device 100 may include a burner 110 which may generate a flame by burning a gas, and a burner cover 130 which may cover the burner 110. The burner assembly 23 may further include a fan cover 180 which covers the burner device 100. The burner assembly 23 may further include a fan 200, and a fan motor 212 for driving the fan 200. The fan 200 may be provided at an outside of the burner cover 130 in the frame 21.

A burner hole 36 through which the burner 110 passes may be formed at the rear wall 35 of the frame 21. The burner 110 may be located in the frame 21, and a part thereof may pass through the burner hole 36, and may be located between the rear wall 35 of the frame 21 and the outer case 11. An exhaust hole 34 through which an exhaust gas is discharged may be formed at the upper wall 33 of the frame 21. Alternatively, exhaust hole 34 may be formed at the rear wall 35 or one of the side walls 31 of the frame, instead of the upper wall 33.

The burner cover 130 may include a first cover 140 and a second cover 160. At least a part of the first cover 140 may cover a front of the burner 110, and at least a part of the second cover 160 may cover a rear of the burner 110. The fan motor 212 may be positioned between the rear wall 35 of the frame 21 and the outer case 11, and the fan 200 may be located in the frame 21. Therefore, a shaft 213 of the fan motor 212 may pass through the rear wall 35 of the frame 21, and may be coupled to the fan 200. The fan motor 212 may be fixed to the rear wall 35 of the frame 21 or the outer case 11 by a motor mount.

The fan cover 180 may protect the burner device 100 and the fan 200. The fan cover 180 may also prevent food leftovers or the like from being moved to the fan 200 and the burner device 100 while the food is cooked. The fan cover 180 may include a front plate 181. The fan cover 180 may further include an extension portion 182 which may extend from the front plate 181 toward the rear wall 35 of the frame 21, and a contact portion 184 which may be bent from the extension portion 182.

An air inlet port 185 through which air in the cooking chamber 22 is suctioned may be formed at the front plate 181, and an air outlet port 186 through which the air heated by the burner device 100 is discharged to the cooking chamber 22 may be formed at the extension portion 182. The air outlet port 186 may be formed at the front plate 181, or may be formed at the front plate 181 and/or the extension portion 182, respectively.

The contact portion 184 may be in contact with the rear wall 35 of the frame 21 while covering the burner device 100. A fastening hole 187 in which a fastening member is fastened may be provided at the contact portion 184. While the fan cover 180 may be fastened to the rear wall 35 of the frame 21 by the fastening member, a lower end of the fan cover 180 may be spaced apart from the bottom wall 32 of the frame 21.

The burner assembly 23 may further include a nozzle holder 220 for injecting the gas to the burner 110. The nozzle holder 220 may be located between the rear wall 35 of the frame 21 and the outer case 11, and may be fixed to, for example, the rear wall 35 of the frame 21. When an insulation is installed at an outside of the frame 21, the nozzle holder 220 may be installed at the insulation. The nozzle holder 220 may be aligned with the burner 110 passed through the rear wall 35 of the frame 21, and may inject the gas to the burner 110.

Figure 5:
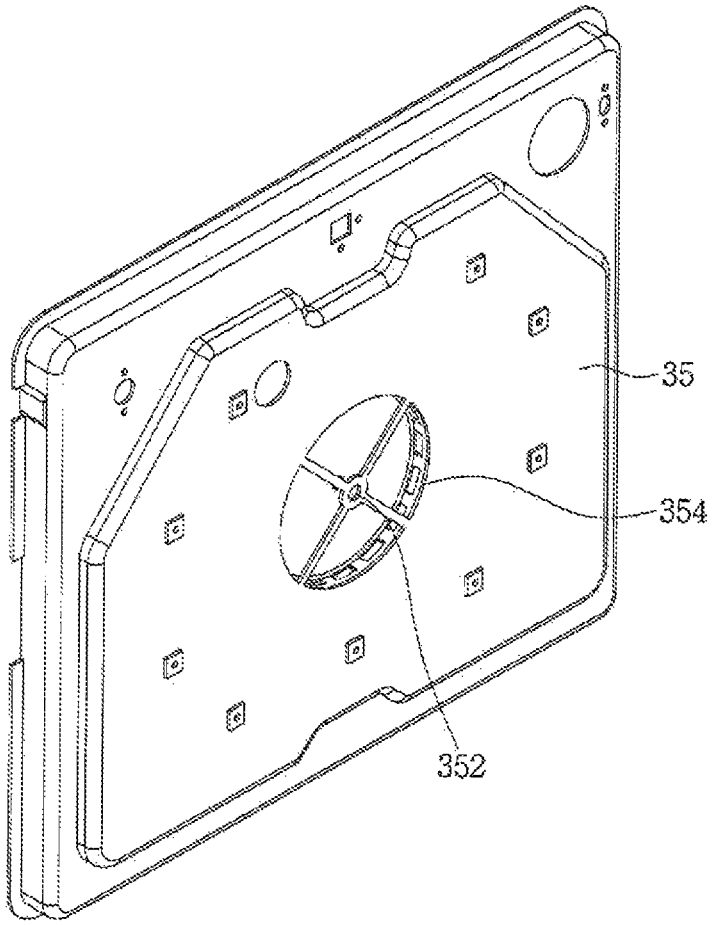
FIG. 5 is a view of a rear wall of a frame according to one embodiment.
Figure 6:
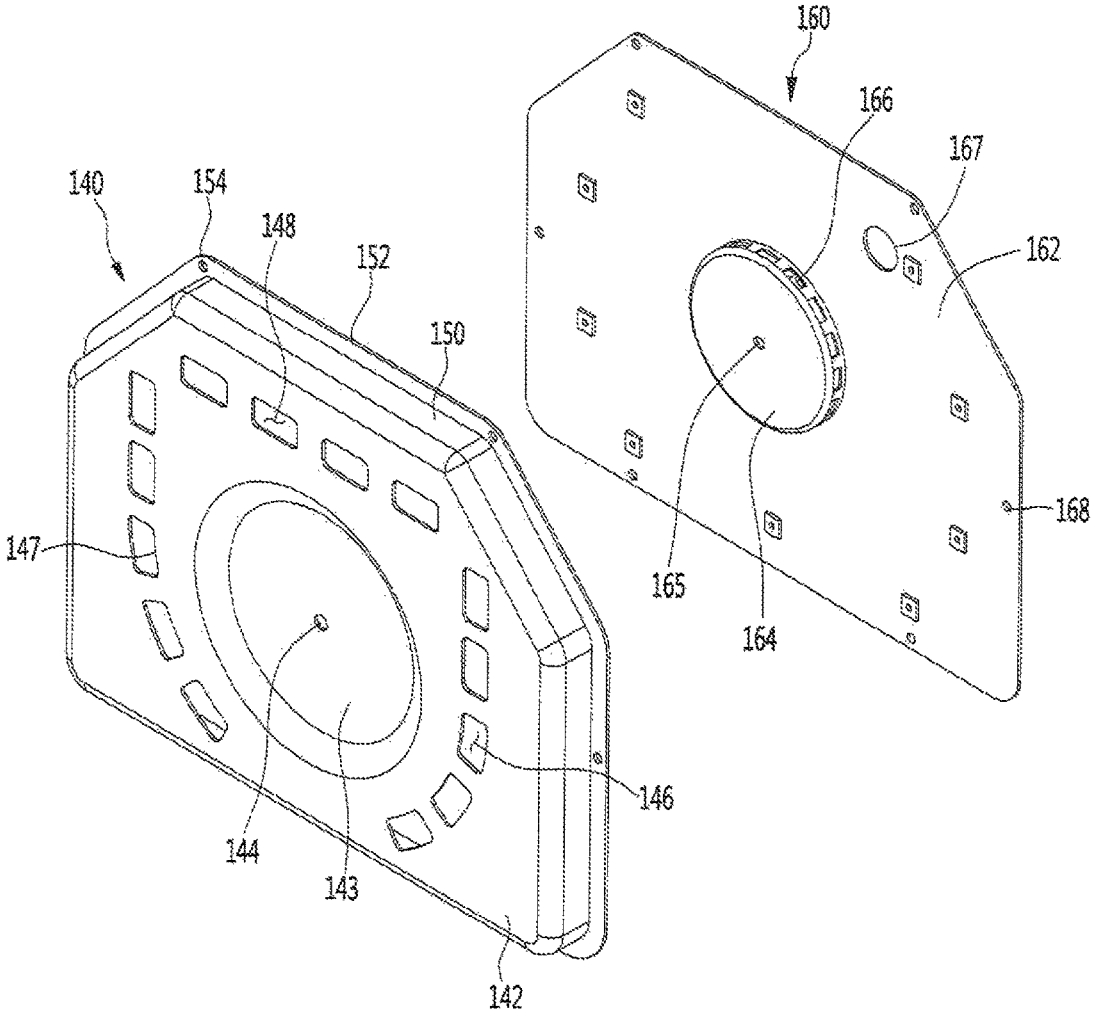
FIG. 6 is an exploded perspective view of a burner cover according to one embodiment.

Referring to FIGS. 4, 5 and 6, a shaft through portion (or a through hole) 352 through which the shaft 213 of the fan motor 212 passes may be provided at the rear wall 35 of the frame 21. An air introduction hole 354 through which the air in the frame 21 is introduced inside the frame 21 may be provided at the rear wall 35. The air introduction hole 354 may be positioned around the shaft through portion 352. When the burner assembly 23 is installed at one of the side walls 31 of the frame 21, the air introduction hole 354 may also be installed at one side wall of the frame 21.

As the air introduction hole 354 may be located around the shaft through-portion 352, the fan motor 212 may be cooled while the air is introduced inside the frame 21 through the air introduction hole 354. The air introduced inside the frame 21 through the air introduction hole 354 may be introduced inside the burner cover 130. The air introduced inside the burner cover 130 may be used to burn a mixed gas in the burner 110, may be heated by the burner 110, and then may be discharged to the cooking chamber 22.

When the burner assembly 23 is coupled to the rear wall 35, the air introduction hole 354 may be prevented from being exposed to an inside of the cooking chamber 22. Therefore, while the food is cooked in the cooking chamber, foreign substances or the like may be prevented from being moved toward the air introduction hole 354. The burner cover 130 may cover the air introduction hole 354, and prevent the introduction hole 354 from being exposed to the cooking chamber 22. According to the embodiment, since the air introduction hole 354 may be located at the rear wall 35, and prevented from being exposed to the inside of the cooking chamber 22, cleanability of the frame 21 may be enhanced, and foreign substances or the like may be prevented from being introduced into the air introduction hole 354.

The burner cover 130 may form a combustion chamber (referring to C in FIG. 8) in which the gas is burned. The burner 110 may be located at the combustion chamber (referring to C in FIG. 8). As described above, the burner cover 130 may include the first cover 140 and the second cover 160. The first cover 140 may include a first plate 142. The first cover 140 may further include a first extension portion (or first extension) 150 which may extend backward from the first plate 142, and a first fastening (or fastening flange) portion 152 which may be bent from the first extension portion 150.

The first cover 140 may further include a fan accommodation portion 143 which provides a space in which at least a part of the fan 200 may be located. The fan accommodation portion 143 may be formed by recessing a part of the first plate 142 toward the second cover 160. A shaft through-hole 144 through which the shaft 213 of the fan motor 212 passes may be formed at the fan accommodation portion 143.

The first cover 140 may include air through-holes 146, 147 and 148 through which the air heated in the combustion chamber (referring to C in FIG. 8) passes. The air through-holes 146, 147 and 148 may be formed at the first plate 142. The air through-holes 146, 147 and 148 may be arranged along a circumference of the fan accommodation portion 143 (or the fan located at the fan accommodation portion). The air through-holes 146, 147 and 148 may include a first air through-hole 146 which may be located at a first side of the fan accommodation portion 143, a second air through-hole 147 which may be located at a second side of the fan accommodation portion 143, and a third air through-hole 148 which may be located at an upper side of the fan accommodation portion 143, but are not limited thereto. The positioning of the air through-holes 146, 147 and 148 may allow the air heated in the combustion chamber (referring to C in FIG. 8) to be uniformly discharged from the burner cover 130 without biasing to one side of the burner cover 130.

The first fastening portion 152 may have one or more first fastening holes 154 through which fastening members may pass. The second cover 160 may be fastened to the first cover 140 by the fastening members. The second cover 160 may include a second plate 162. The second plate 162 may include one or more second fastening holes 168 which are aligned with the first fastening holes 154 of the first cover 140.

The second cover 160 may further include an air introduction guide 164 which may guide an introduction of air from outside the frame 21. The air introduction guide 164 may protrude from the second plate 162 toward the first cover 140. That is, the air introduction guide 164 may extend toward the fan 200. The air introduction guide 164 may be in contact with the fan accommodation portion 143, but is not limited thereto.

The air introduction guide 164 may have a shaft through-hole 165 through which the shaft 213 of the fan motor 212 passes. Therefore, the shaft 213 of the fan motor 212 may pass through the shaft through portion 352 of the frame 21, the shaft through-hole 165 of the second cover 160, and the shaft through-hole 144 of the first cover 140, and then may be coupled to the fan 200. The air introduction guide 164 may be formed in a cylindrical shape, and an air introduction opening 166 may be provided at a circumference of the air introduction guide 164. A plurality of air introduction openings 166 may be arranged in a circumferential direction of the air introduction guide 164.

The air introduced inside the frame 21 through the air introduction hole 354 provided at the rear wall 35 of the frame 21 may be introduced into the combustion chamber (referring to C in FIG. 8) in the burner cover 130 through the air introduction opening 166. The second cover 160 may further include a burner through-hole 167 through which the burner 110 may pass.

Figure 7:
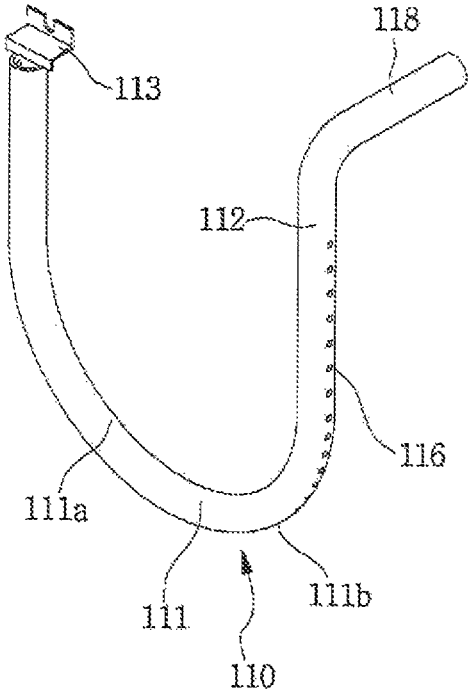
FIG. 7 is a perspective view of a burner according to one embodiment.

Referring to FIGS. 4 and 7, the burner 110 according to the embodiment may include a burner tube 111 of which both ends are spaced apart from each other. In the embodiment, the burner tube 111 may be formed in a non-annular shape. At least a part of the burner tube 111 may be informed in a "U" shape, but is not limited thereto.

A supply part 118 through which the gas and the air are supplied may be provided at a first end 112 of the burner tube 111, and a second end 113 of the burner tube 111 may be blocked. The supply part 118 may be connected to the nozzle holder 220. The supply part 118 may extend to be inclined from the first end 112 of the burner tube 111. Therefore, a flow direction of the gas and the air supplied through the supply part 118 may be changed at the first end 112, and then the gas and the air may flow along the burner tube 111 toward the second end 113. The gas and the air supplied through the supply part 118 may flow in the burner tube 111 in only one direction.

The entire burner tube 111 may be formed in a curved shape, or one or more of the first end 112 and the second end 113 may be formed in a linear shape, and the other portions thereof may be formed in the curved shape. The burner tube 111 may include an inner circumferential surface 111*a* and an outer circumferential surface 111*b*.

A plurality of gas outlet holes 116 may be provided at the outer circumferential surface 111*b* of the burner tube 111. The plurality of gas outlet holes 116 may be arranged to be spaced apart at regular intervals from each other in an extension direction of the burner tube 111. The burner 110 may be fastened to the burner cover 130, and thus a position thereof may be fixed.

Figure 8:
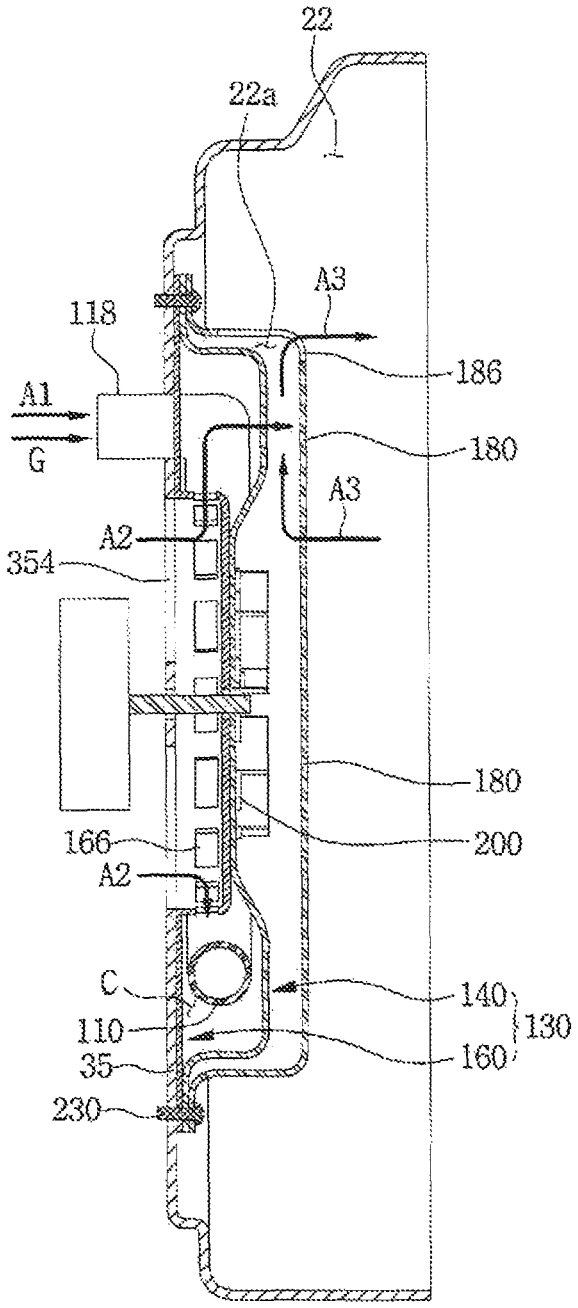
FIG. 8 is a vertical cross-sectional view illustrating a state in which the burner assembly according to one embodiment is installed at the frame.
Figure 9:
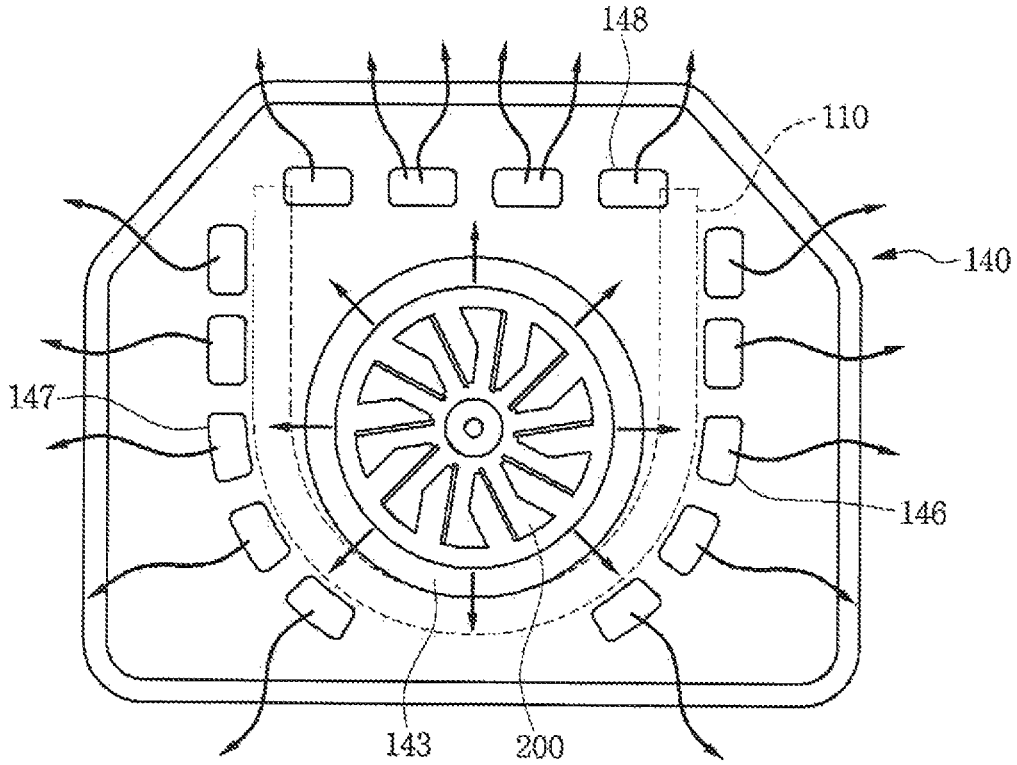
FIG. 9 is a view illustrating an air flow in the burner cover when a fan is rotated.

Referring to FIGS. 4, 8 and 9, the fan cover 180 may divide an internal space of the frame 21 into the cooking chamber 22 and an air flow chamber 22*a* partitioned from the cooking chamber 22. Therefore, the fan cover 180 may be referred to as a partition plate. The burner cover 130 may form the combustion chamber C in the air flow chamber 22*a*. A space in the air flow chamber 22*a* in which the air in the cooking chamber flows may be a space between the burner cover 130 and the fan cover 180.

The fan cover 180, the first cover 140, the second cover 160 and the rear wall 35 of the frame 21 may be fastened with a single fastening member (or fastener) 230, but the embodiment is not limited thereto. The fastening member 230 may pass, in turn, through the fastening hole 187 of the fan cover 180, the first fastening hole 154 of the first cover 140 and the second fastening hole 168 of the second cover 160, and then may be fastened to the rear wall 35 of the frame 21.

While the burner assembly 23 is fastened to the rear wall 35 of the frame 21, at least a part of a front surface of the burner cover 130 may be spaced apart from at least a part of a rear surface of the fan cover 180. The first cover 140 may be spaced apart from the fan cover 180.

The fan 200 may be located between the first cover 140 and the fan cover 180. Therefore, the burner 110 may be located closer to the rear wall 35 of the frame 21 than the fan 200. The fan 200 may be located between one wall of the frame 21 at which the air introduction hole 354 is formed and the air inlet port 185. While the fan 200 is located at the fan accommodation portion 143 of the first cover 140, the fan 200 may be spaced apart from the fan cover 180.

The burner 110 may be located outside the air introduction guide 164 while being fixed to the burner cover 130. At least a part of the burner 110 may be positioned to cover an outside of the air introduction guide 164 while being spaced apart from the air introduction guide 164.

A distance from a center (or the shaft of the fan motor) of the fan 200 to the air through-holes 146, 147 and 148 may be formed longer than a distance from the center (or the shaft of the fan motor) of the fan 200 to the outer circumferential surface of the burner 110 so that the air in the air flow chamber 22*a* may be rapidly heated by the flame generated from the gas outlet holes 116. Therefore, the flame generated from the burner 110 may extend toward the air through-holes 146, 147 and 148.

When the operation of the burner assembly 23 is started, gas may be injected from the nozzle holder 220 to the supply part 118 of the burner 110. Air (A1) (air outside the frame) around the supply part 118 may then be supplied to the supply part 118 together with the gas. At this time, since a low pressure is formed around the gas supplied to the supply part 18, the air (A1) around the supply part 118 may be naturally supplied to the supply part 118 due to a pressure difference (in a natural ventilation method).

When the air is supplied to the supply part 118 in the natural ventilation method, the air necessary to burn the gas may not be sufficiently supplied to the supply part 118. In this case, an imperfect combustion of a mixed gas in which the gas and the air are mixed may occur in the burner 110, and thus there may be a problem that a carbon monoxide generation rate due to the imperfect combustion is increased.

While the fan 200 is rotated, additional air A2 for combustion of the mixed gas in the burner 110 may be introduced into the combustion chamber C through the air introduction hole 354 of the frame 21 and the air introduction openings 166 of the burner cover 130. Since the plurality of air introduction openings 166 are arranged at the circumference of the air introduction guide 164, the air may be evenly supplied to the burner 110. Since the additional air A2 is smoothly supplied to the combustion chamber C, the imperfect combustion of the mixed gas in the burner 110 may be minimized, and thus the carbon monoxide generation rate may be minimized.

When the fan 200 is rotated, the air in the cooking chamber 22 may be introduced into the air flow chamber 22*a* through the air inlet port 185 of the fan cover 180. At this time, air A3 introduced into the air flow chamber 22*a* may flow toward the air through-holes 146, 147 and 148. The air A3 flowed toward the air through-holes 146, 147 and 148 may be heated by heat of the flame of the burner 110 discharged through the air through-holes 146, 147 and 148.

The additional air A2 introduced into the combustion chamber C may be used for the combustion in the burner 110, pass through the air through-holes 146, 147 and 148, and may then be introduced into the air flow chamber 22*a*. The additional air A2 introduced from the combustion chamber C into the air flow chamber 22*a* may be discharged again to the cooking chamber 22 through the air outlet port 186 of the fan cover 180 together with the air A3 introduced from the cooking chamber 22 into the air flow chamber 22*a*.

Since the plurality of air through-holes 146, 147 and 148 may be arranged along the circumference of the fan accommodation portion 143, the heat of the burner and the heated air may be evenly introduced into the entire air flow chamber 22*a*. Accordingly, the air A3 in the cooking chamber introduced into the air flow chamber 22*a* may be rapidly heated. Since the fan 200 may be located at the fan accommodation portion 143 of the burner cover 130 in the air flow chamber 22*a*, a forward and backward width of the burner assembly 23 may be prevented by the fan 200 from being increased, and thus a volume of the cooking chamber 22 may be increased.

Figure 10:
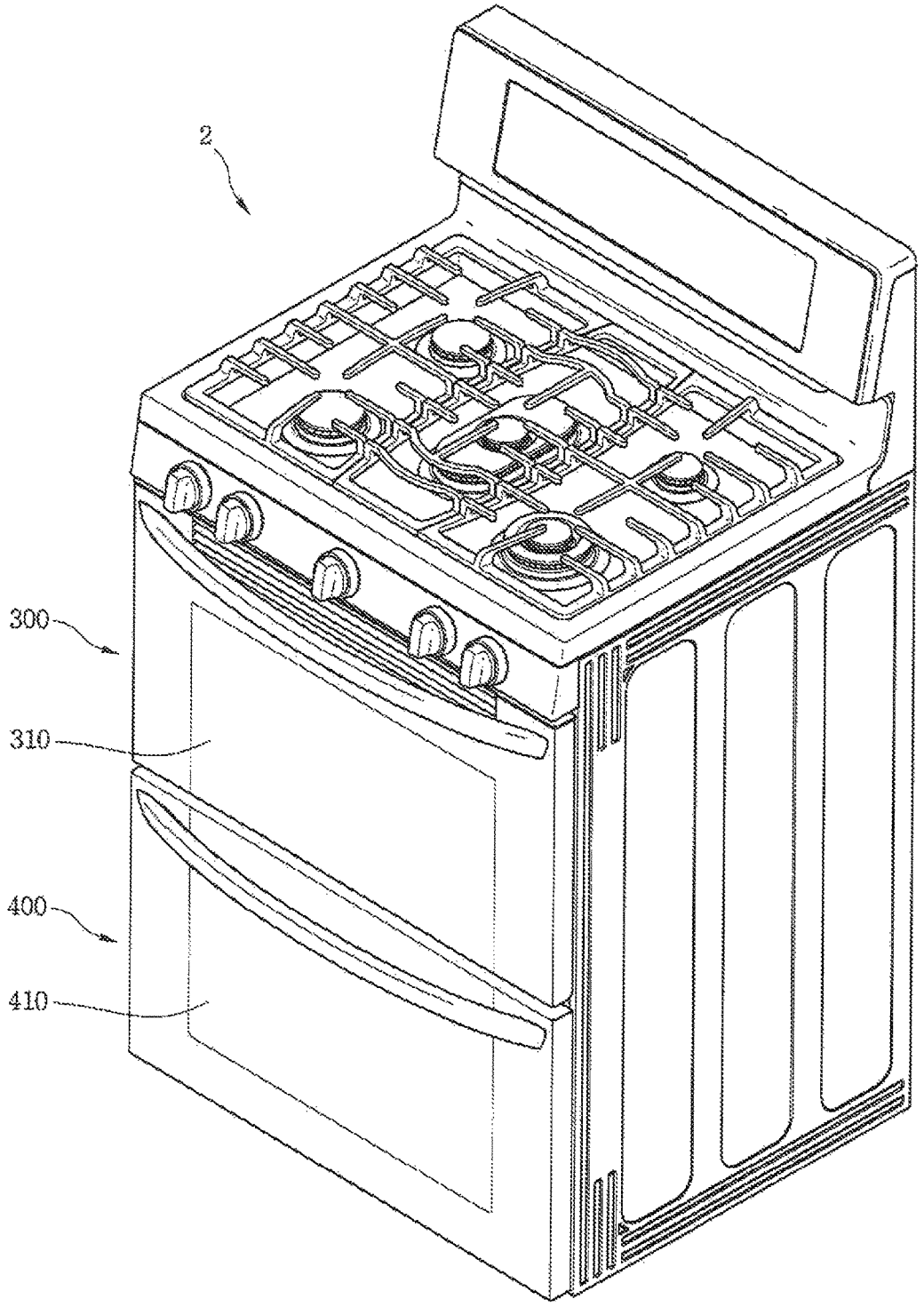
FIG. 10 is a perspective view of a cooking apparatus according to another embodiment.
Figure 11:
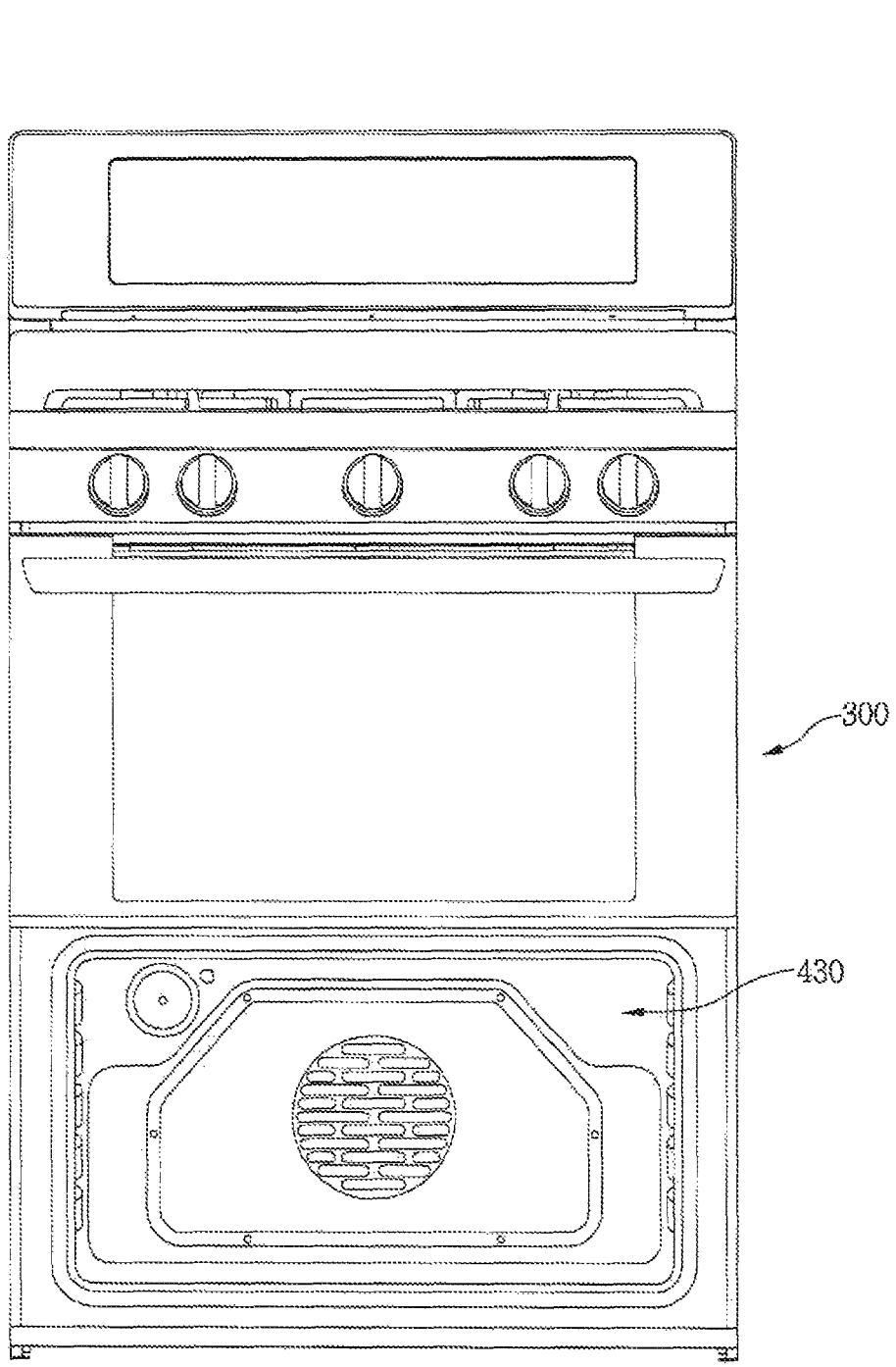
FIG. 11 is a front view of the cooking apparatus in which a second door is separated from FIG. 10.

FIG. 10 is a perspective view of a cooking apparatus according to another embodiment, and FIG. 11 is a front view of the cooking apparatus in which a second door is separated from FIG. 10. The embodiment may be substantially the same as the above-described embodiment except the number of oven units, and description of the similar components may be omitted. A cooking apparatus 2 may include a plurality of oven units (or ovens) 300 and 400. The plurality of oven units 300 and 400 may include a first oven unit (or oven) 300, and a second oven unit (or oven) 400 which may be located under the first oven unit 300. The plurality of oven units 300 and 400 may include doors 310 and 410, respectively.

A burner assembly 430 may be provided at one or more of the plurality of oven units 300 and 400. Since a structure of the burner assembly 430 is the same as that of the burner assembly described in the previous embodiment, detailed description thereof will be omitted.

FIG. 11 illustrates an example in which the burner assembly 430 is provided at the second oven unit 400. However, the burner assembly 430 may be provided at the first oven unit 300, or may be provided at each of the plurality of oven units 300 and 400.

According to the present disclosure a cooking apparatus may include a frame configured to form a cooking chamber; a burner cover provided within the frame and configured to form a combustion chamber; a burner provided within the combustion chamber; a fan provided at an outside of the burner cover in the frame; and a fan cover configured to cover the fan and the burner cover.

A cooking apparatus may include a frame; a partition plate fixed to the frame in the frame and configured to divide an internal space of the frame into a cooking chamber and an air flow chamber; a burner cover provided at the air flow chamber and configured to form a combustion chamber; a burner provided in the combustion chamber; and a fan provided outside the burner cover in the air flow chamber, wherein the fan is provided between at least a part of the partition plate and the burner cover.

In the description of embodiments, terms such as first, second, A, B, (a), (b) or the like may be used herein when describing components of the embodiments. Each of these terminologies is not used to define an essence, order or sequence of a corresponding component but used merely to distinguish the corresponding component from other component(s). It should be noted that if it is described in the specification that one component may be "connected," "coupled" or "joined" to another component, the former may be directly "connected," "coupled," and "joined" to the latter or "connected", "coupled", and "joined" to the latter via another component.

In the specification, a "front" may be a direction toward a front surface of the cooking apparatus 1, and a "rear" may be a direction toward a rear surface of the cooking apparatus 1. In the cooking chamber 22, a "front" may be a direction toward the door 25 of the oven unit 20, and a "rear" may be a direction toward the rear wall 35 of the frame 21. In the specification, "located in the frame" may mean "located in a space in which the frame is formed".

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking apparatus comprising:

a frame having a cooking chamber;

a burner cover provided in the frame to form a combustion chamber;

a burner provided within the combustion chamber;

a fan provided at an outside of the burner cover in the frame; and a fan cover configured to cover the fan and the burner cover, wherein the frame includes an air introduction hole through which air from outside the frame is introduced into the frame, wherein the burner cover covers the air introduction hole, the burner cover having a plurality of air introduction openings through which the air passed through the air introduction hole is introduced into the combustion chamber, wherein the burner cover includes a first cover and a second cover, wherein the first cover covers a front of the burner, wherein the second cover covers a rear of the burner, and the second cover includes an air introduction guide in which the plurality of the air introduction openings are formed.

2. The cooking apparatus of claim 1, wherein the plurality of air introduction openings are arranged along a circumference of the air introduction guide.

3. The cooking apparatus of claim 2, wherein the burner is provided outside of the air introduction guide, and at least a part of the burner is arranged to surround the circumference of the air introduction guide while being spaced apart from the air introduction guide.

4. The cooking apparatus of claim 1, wherein the burner cover further includes at least one air through-hole through which the air introduced into the combustion chamber passes, and the air introduced into the combustion chamber through the air introduction opening is heated by a flame of the burner, to pass through the at least one air through-hole.

5. The cooking apparatus of claim 4, wherein the burner cover includes a plurality of the air through-holes, and the plurality of the air through-holes are arranged along a circumference of the fan in the burner cover.

6. The cooking apparatus of claim 1, further including a fan motor to rotate the fan, a shaft of the fan motor passing through the frame and the burner cover and being connected to the fan.

7. The cooking apparatus of claim 1, wherein the burner cover includes a fan accommodation portion in which at least a part of the fan is accommodated.

8. The cooking apparatus of claim 7, wherein the fan accommodation portion is formed by recessing a part of the burner cover toward the frame.

9. The cooking apparatus of claim 8, wherein the air introduction guide extends toward the fan, and wherein the fan accommodation portion is in contact with the air introduction guide.

10. The cooking apparatus of claim 9, wherein the fan accommodation portion is formed in the first cover, and the second cover is fastened to the first cover.

11. The cooking apparatus of claim 1, wherein the fan cover and the burner cover form an air flow chamber, the fan cover having an air inlet port through which air in the cooking chamber is introduced into the air flow chamber, and an air outlet port through which the air in the air flow chamber is discharged to the cooking chamber.

12. The cooking apparatus of claim 11, wherein the air introduced into the combustion chamber through the plurality of air introduction openings is heated in the combustion chamber, introduced into the air flow chamber, and discharged into the cooking chamber through the air outlet port together with the air introduced from the cooking chamber into the air flow chamber.

13. The cooking apparatus of claim 1, further including a single fastener which fastens the burner cover, the fan cover, and the frame to each other.

14. The cooking apparatus of claim 1, wherein the fan is located between the fan cover and the burner cover, a part of the burner cover is located between the fan and the burner, and the burner is arranged closer to the frame than the fan.

15. The cooking apparatus of claim 1, wherein the air introduction guide is formed as a cylindrical boss that protrudes from a first surface of the second cover.

16. The cooking apparatus of claim 15, wherein the plurality of air introduction openings radially penetrate a circumferential surface of the air introduction guide.

* * * * *